United States Patent [19]

Nooteboom

[11] 4,262,620

[45] Apr. 21, 1981

[54] MOORING DEVICE

[75] Inventor: Urias G. Nooteboom, The Hague, Netherlands

[73] Assignee: Blue Water Terminal Systems N.V., Curacao, Netherlands Antilles

[21] Appl. No.: 14,481

[22] Filed: Feb. 23, 1979

[30] Foreign Application Priority Data

Feb. 28, 1978 [NL] Netherlands ..... 7802200

[51] Int. Cl.[3] ..... B63B 21/00

[52] U.S. Cl. ..... 114/230

[58] Field of Search ..... 9/8 R, 8 P; 114/230, 114/231; 141/387, 388

[56] References Cited

U.S. PATENT DOCUMENTS

| | | | |
|---|---|---|---|
| B 484,769 | 3/1976 | Flory | 114/230 |
| 3,572,408 | 3/1971 | Hnot | 114/230 |
| 3,841,357 | 10/1974 | van Heijst | 9/8 P |

FOREIGN PATENT DOCUMENTS

| | | | |
|---|---|---|---|
| 2159703 | 6/1973 | France | 9/8 P |
| 2303702 | 10/1976 | France | 9/8 P |
| 977272 | 12/1964 | United Kingdom | 9/8 P |

*Primary Examiner*—Douglas C. Butler
*Assistant Examiner*—Jesús D. Sotelo
*Attorney, Agent, or Firm*—Arnold, White & Durkee

[57] ABSTRACT

The invention relates to a mooring device in the form of a buoyant body held in position by an anchor the connection with the anchor being formed by two arms one of which extending downwardly from the body and having a universal joint with the body as well as a cardan joint with two horizontal axes with the second arm, which extends downwardly at sharp angle with the vertical towards the anchor to which this arm has a connection with only one pivot axis which extends horizontally, the arms being loaded by a weight.

7 Claims, 3 Drawing Figures

MOORING DEVICE

The invention relates to a mooring device comprising a body with buoyancy which at least partly extends above water level and which has been connected to an anchor at the bottom of the body of water by means of a connecting member comprising an arm which has been connected to the anchor pivotably about a horizontal axis and which extends obliquely upwardly from the anchor and further comprising a tension member which has been connected to the upper end of the arm pivotably about a horizontal axis, said tension member extending straight upwardly, a medium conduit extending along said connecting member, which connecting member is loaded by means of a weight. A mooring device of this type is known for instance from French Pat. No. 2,159,703.

For mooring a vessel to a mooring device six degrees of freedom are necessary. The known mooring device has two degrees of freedom in the form of a horizontal and a vertical pivot axis at the location of the anchor and has one degree of freedom in the form of a horizontal pivot axis at the connection between the arm and the tension member. As a consequence the medium conduit needs a swivel at the location of the anchor which swivel in particular at great depth is difficult to reach for maintenance. Furthermore the horizontal axis between the upper end of the arm and the lower end of the tension member is heavily loaded and easily overloaded in case the vessel in swinging around the mooring device is pulling at it in a transverse direction.

With said known device the body with buoyancy has been rigidly connected to the upper end of the tension member and accordingly has no degrees of freedom with respect to said member. The required further degrees of freedom are to be found in the anchor line connection between vessel and floating body and in this known mooring arrangement the fluid conduit between the floating body and the vessel is formed by a hose. This hose is heavily overloaded in case the vessel swings around the mooring arrangement.

Purpose of the invention is to provide a more simple mooring device avoiding the above mentioned disadvantages.

Acording to the invention this purpose has been achieved in that the connection with the anchor is exclusively pivotable about a horizontal axis and the horizontal pivot connection between the arm and the tension member is formed by a universal joint with two horizontal pivot axes, the upper end of the tension member being connected to the body with buoyancy about three pivot axes which extend perpendicular to each other.

Due to the fact that at the location of the anchor there is only a horizontal pivot axis the arm can only swing in a plane perpendicular to said axis. This arm preferably has the shape of a trapezoidal frame connected to the anchor with its broad basis. In this way a strong structure is possible capable of taking up transverse loads which occur when the vessel swings around.

The presence of only one pivot axis makes it possible to avoid a swivel at the anchor. It is sufficient to use a flexible hose.

A universal joint between the upper end of the arm and the lower end of the tension member avoids overloading at this point and still allows the use of a hose in the medium conduit to pass this pivot point in the connection.

The remaining three degrees of freedom are now close or above water level at the connection with the floating body. This body can be a mooring buoy to which a vessel can be moored or can be a mooring arrangement in the form of for instance a vessel, provided with a forwardly extending arm to which the universal joint with the three axes of rotation has been connected.

When the mooring arrangement is such that the vessel or the buoy must be able to swing around over 360° a swivel will be necessary at this point, but this swivel can be located above water level and accordingly easily maintained.

When the vessel itself has a limited degree of freedom by anchor lines it will only be able to swing about the upper end of the tension member over a relatively small angle in which case the medium conduit need not to have a swivel but also can be formed by a flexible hose to overbridge this point.

Preferably according to the invention the weight preferably is formed by a body carrying the pivots of the universal joint between the upper end of the arm and the lower end of the tension member. In this way the space present in the cardan joint is effectively used.

According to an other embodiment the tension member can be in the form of a framework column having the weight at its lower end.

The invention now will be further elucidated with reference to the drawings.

FIG. 1 gives a diagrammatic sideview of one embodiment of the device according to the invention.

Figure 1:
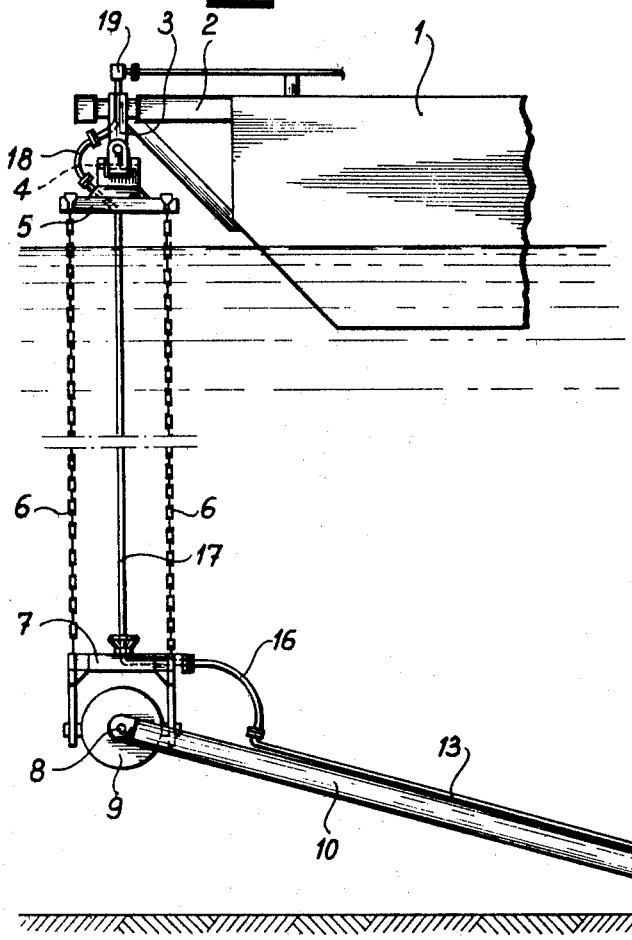

FIG. 1 shows a floating body 1 in the form of a vessel which in a way comparable to the vessel known from U.S. Pat. No. 3,335,690 has been provided with an outwardly extending part 2 in which rotatable about a vertical axis an intermediate member 3 has been supported which carries a cardan joint 4 to which has been connected a yoke 5. Said yoke 5 by means of chains 6 has been connected to a yoke 7 of a cardan joint 8, within which the weight 9 has been enclosed.

Said weight has been connected to the outer end of an arm 10 which at 11 has been connected to the anchor 12 pivotably about a horizontal axis.

A conduit 13 has been connected along the arm 10 which conduit by means of a hose 14 is connected to a conduit 15 mounted in the anchor 12 and by means of a hose 16 to a conduit 17 extending between the yokes 5 and 7, said hose 16 serving to overbridge the cardan joint 8, which conduit 17 by means of a hose 18 overbridges the cardan joint 4 and then joins a tube debouching into a swivel 19.

Instead of one arm as shown it is possible to use more than one arm connected to the same anchor.

Figure 3:
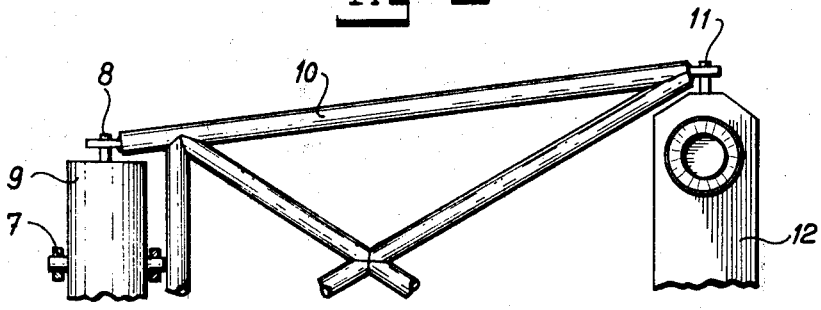
FIG. 3 shows a top view of approximately one half of an embodiment of part of the device shown in FIG. 1.

FIG. 3 shows a possible embodiment of the arm 10 in the form of a trapezoidal frame, the broad base of which at 11 has been connected to the anchor 12.

Figure 2:
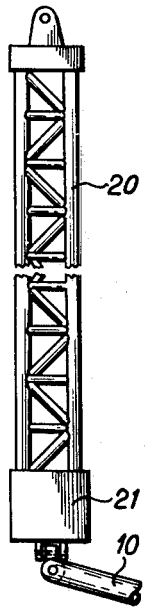
FIG. 2 is a sideview of an other embodiment in the same way as FIG. 1 but with parts taken away.

FIG. 2 shows a different embodiment for the tension member. Instead of the chains 6 a framework 20 is used having a weight 21 at its lower end below which a cardan joint has been provided for the connection to the arm 10, while its upper end forms part of the cardan joint 4, not shown.

I claim:

1. A mooring device comprising:

a body with buoyancy which at least partly extends above water level;

a connecting member connecting the body to an anchor at the bottom of the body of water, the anchor having a conduit mounted therein;

the connecting member comprising an arm pivotably connected to the anchor about a horizontal axis to extend obliquely upwardly from the anchor, the pivotal connection between the arm and the anchor being such that the arm can pivot exclusively about the horizontal axis and is prevented from pivoting about a vertical axis relatively to the anchor, and a tension member having a lower end pivotably connected to the upper end of the arm by means of a universal joint comprising only two horizontally extending pivot axes for the tension member to extend vertically upwardly from the arm, the tension member having an upper end connected to the body by means of a joint including two perpendicular horizontal axes, and a vertical pivot axis which extends above water level;

the tension member being loaded by means of a weight for maintaining it in its vertical position; and a medium conduit extending along the connecting member, the medium conduit comprising a conduit extending along the arm and having its lower end connected to the conduit mounted in the anchor by means of a flexible hose bridging the pivotal connection between the arm and the anchor, a conduit extending along the tension member and having its lower end connected to the upper end of the conduit extending along the arm by means of a flexible hose bridging the universal joint between the tension member and the arm, and a tube leading to the body, the tube having its lower end connected to the upper end of the conduit extending along the tension member by means of a flexible hose bridging the horizontal axes of the joint between the body and the tension member.

2. A mooring device according to claim 1 in which the vertical pivot axis is defined by an intermediate member which is rotatably supported in the body for rotational movement of the body about the intermediate member, and in which the tube has a swivel above water level.

3. A mooring device according to claim 2, in which the tube extends along the axis of the intermediate member, and in which the joint including the two horizontal pivot axes is carried by the intermediate member.

4. A mooring device according to claim 1 in which the weight is provided at the lower end of the tension member, and in which the pivot axes of the universal joint between the tension member and the arm are mounted on and extend outwardly from the weight.

5. A mooring device according to claim 1, in which the arm is of trapezoidal shape having a broad base tapering inwardly to a narrow upper end, with the broad base being connected to opposed ends of the horizontal pivot axis of the anchor.

6. A mooring device according to claim 1, in which the body is in the form of a vessel.

7. A mooring device according to claim 1, in which the tension member is in the form of a framework column having the weight at its lower end.

* * * * *